US009563176B2

(12) United States Patent
Kawaguchi et al.

(10) Patent No.: US 9,563,176 B2
(45) Date of Patent: Feb. 7, 2017

(54) TIME MEASUREMENT DEVICE

(71) Applicants: SEIKO EPSON CORPORATION, Tokyo (JP); CASIO COMPUTER CO., LTD., Shibuya-ku, Tokyo (JP)

(72) Inventors: Takashi Kawaguchi, Nagano (JP); Katsuaki Karasawa, Hamura (JP); Hideyuki Arai, Hamura (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/692,111

(22) Filed: Apr. 21, 2015

(65) Prior Publication Data

US 2015/0309479 A1 Oct. 29, 2015

(30) Foreign Application Priority Data

Apr. 23, 2014 (JP) ..... 2014-089327

(51) Int. Cl.
*G04F 8/00* (2006.01)
*G04F 7/08* (2006.01)

(52) U.S. Cl.
CPC ..... *G04F 8/006* (2013.01); *G04F 7/08* (2013.01); *G04F 7/088* (2013.01); *G04F 7/0842* (2013.01); *G04F 7/0871* (2013.01)

(58) Field of Classification Search
CPC ..... G04F 7/08; G04F 7/0842; G04F 7/0871; G04F 7/088; G04C 3/14; G04C 3/146
(Continued)

(56) References Cited

U.S. PATENT DOCUMENTS 490,123 A * 1/1893 Nicolet ..... G04F 7/08 368/104
3,089,085 A * 5/1963 Frank ..... G04F 8/08 368/113

(Continued)

FOREIGN PATENT DOCUMENTS

JP 2007-256066 A 10/2007
JP 2009-019987 A 1/2009

(Continued)

OTHER PUBLICATIONS

Morita et al., Translation of JP 2013029400, Feb. 7, 2013, whole document.*

(Continued)

*Primary Examiner* — Amy Cohen Johnson
*Assistant Examiner* — Daniel Wicklund
(74) *Attorney, Agent, or Firm* — Global IP Counselors, LLP

(57) ABSTRACT

A time measurement device includes: a higher-digit indication hand that is configured to indicate a higher digit of a measured time; a lower-digit indication hand that is configured to reciprocate and indicate a lower digit of the measured time on a forward route and on a return route; a first drive unit that is configured to drive the higher-digit indication hand; a second drive unit that is configured to drive the lower-digit indication hand; a time counter that is configured to measure a time; a first drive controller that is configured to control the first drive unit to drive the higher-digit indication hand based on the measured time measured by the time counter; and a second drive controller that is configured to control the second drive unit to drive the lower-digit indication hand based on the measured time measured by the time counter, the second drive controller reciprocating the lower-digit indication hand at a predetermined period, and the first drive controller moving the (Continued)

higher-digit indication hand at a time interval equal to or less than a half of the predetermined period.

5 Claims, 13 Drawing Sheets

(58) Field of Classification Search
USPC ..... 368/102, 110–113
See application file for complete search history.

(56) References Cited

U.S. PATENT DOCUMENTS 4,270,197 A * 5/1981 Minowa ..... G04F 8/006 368/113
4,655,606 A * 4/1987 Giger ..... G04F 8/003 368/113
8,348,495 B2 * 1/2013 Kamiya ..... G04F 7/08 368/110
2004/0022133 A1 * 2/2004 Schmiedchen ..... G04F 7/0871 368/110
2004/0170088 A1 * 9/2004 Seyr ..... G04F 7/08 368/110
2006/0280037 A1 * 12/2006 Houlon ..... G04C 3/146 368/110

FOREIGN PATENT DOCUMENTS

JP 2009281961 A * 12/2009
JP 2011-053118 A 3/2011
JP 2013-029400 A 2/2013

OTHER PUBLICATIONS

Shiraishi, Toshiya, English Translation of JP 2009281961, originally published Dec. 3, 2009, full document.*

* cited by examiner

FIG. 3

| HAND | DISPLAY UNIT | SEGMENTS | STEP NUMBER OF DISPLAY UNIT | MEASURED VALUE PER ONE ROTATION |
|---|---|---|---|---|
| 1/10 SECOND CHRONOGRAPH HAND | 1/10 SECONDS | 20 | 4 | 1 SECOND |
| CHRONOGRAPH SECOND HAND | 1/2 SECONDS | 120 | 1 | 60 SECONDS |
| CHRONOGRAPH MINUTE HAND | 1 MINUTE | 60 | 1 | 60 MINUTES |

FIG.4

| COUNT VALUE | DRIVE PULSE TYPE | DRIVE PULSE NUMBER |
|---|---|---|
| "0.1", "0.2", "0.3", "0.4", "0.5" | CLOCKWISE DRIVE PULSE | 4 |
| "0.6", "0.7", "0.8", "0.9", "0" | ANTICLOCKWISE DRIVE PULSE | 4 |

TIME MEASUREMENT DEVICE

The entire disclosure of Japanese Patent Application No. 2014-089327, filed Apr. 23, 2014 is expressly incorporated by reference herein.

BACKGROUND

1. Technical Field

The present invention relates to a time measurement device including a reciprocating hand.

2. Related Art

Chronograph timepieces that display not only the current time but also measure the time to display the measured time have been known. Some of the chronograph timepieces indicate a value of sub-second digit of the measured time using a reciprocating hand (see, for instance, Patent Literature 1: JP-A-2013-29400, and Patent Literature2: JP-A-2007-256066).

An electronic timepiece disclosed in Patent Literature 1 uses a reciprocating 1/10 second hand to indicate 1/10 second. The movement direction of the hand is reversed every 0.5 seconds. The hand indicates seconds in a range from 0 to 0.5 seconds when the hand is on a forward route, while the hand indicates seconds a range from 0.5 to 1.0 seconds when the hand is on a return route. Positions to be pointed by the 1/10 second hand of the electronic timepiece are shifted from positions pointed to be pointed on the forward route so that whether the 1/10 second hand is on the forward route or on the return route can be recognized even when the 1/10 second hand is stopped after the time measurement. Accordingly, 1/10 second graduations provided around a movement area of the 1/10 second hand include forward-route indexes (i.e. indexes for indicating 0 to 0.5 seconds) and return-route indexes (i.e. indexes for indicating 0.5 to 1.0 seconds) that are mutually shifted so as not to be overlapped in the pointing direction of the hand.

An electronic chronograph timepiece disclosed in Patent Literature 2 uses a reciprocating hand to indicate 1/20 seconds. The hand indicates the measured time (0/20 to 19/20 seconds) only in a forward route. Then, the hand of the electronic chronograph timepiece returns to an initial position (0/20 second position) on the return route.

The electronic timepiece disclosed in the Patent Literature 1 entails a problem that, when the display area of the 1/10 second graduations is small, intervals between the forward-route indexes and the return-route indexes cannot be sufficiently secured, so that it is difficult to determine which of the forward-route indexes and the return-route indexes are pointed by the 1/10 second hand.

The electronic chronograph timepiece disclosed in Patent Literature 2 requires a time lag for returning the hand to the initial position (i.e. a time for returning the hand from 19/20 second position to 0/20 second position), so that the time indicated by the hand cannot always be the same as the measured time. Accordingly, when the time indicated by the hand is not the same as the measured time when the measurement is completed, it is necessary to move the hand to the position indicating the measured time, so that the measured time cannot be immediately recognized.

SUMMARY

An object of the invention is to provide a time measurement device that includes a reciprocating hand capable of quickly indicating a measured time in an easily recognizable manner.

A time measurement device according to an aspect of the invention includes: a higher-digit indication hand that is configured to indicate a higher digit of a measured time; a lower-digit indication hand that is configured to reciprocate and indicate a lower digit of the measured time on a forward route and on a return route; a first drive unit that is configured to drive the higher-digit indication hand; a second drive unit that is configured to drive the lower-digit indication hand; a time counter that is configured to measure a time; a first drive controller that is configured to control the first drive unit to drive the higher-digit indication hand based on the measured time measured by the time counter; and a second drive controller that is configured to control the second drive unit to drive the lower-digit indication hand based on the measured time measured by the time counter, in which the second drive controller reciprocates the lower-digit indication hand at a predetermined period, and the first drive controller moves the higher-digit indication hand at a time interval equal to or less than a half of the predetermined period.

When, for instance, a start button is pressed, the time counter starts measuring time.

At this time, since the lower-digit indication hand of the above aspect of the invention indicates the measured time on the forward route and the return route, in other words, since the time required for returning the hand to a start position is not necessary unlike in an instance where the measured time is indicated solely on the forward route, the time indicated by the lower-digit indication hand and the measured time can be always the same.

Accordingly, the value of lower digit of the measured time can be quickly indicated after a stop button is pressed to stop the measurement.

Further, since the higher-digit indication hand of the above aspect of the invention moves at a time interval that is half or less of that of a reciprocatory motion of the lower-digit indication hand, the position pointed by the higher-digit indication hand changes depending on whether the lower-digit indication hand is on the forward route or on the return route. Accordingly, it can be determined whether the lower-digit indication hand is on the forward route or on the return route depending on the measured time indicated by the higher-digit indication hand.

For instance, when the higher-digit indication hand is a second hand while the lower-digit indication hand indicates a digit of 1/10 seconds and reciprocates at an interval of one second, the higher-digit indication hand moves at an interval of 0.5 seconds or less. In this case, supposing that a distance between exact second positions is defined as a between-exact-seconds distance, when the second hand does not reach a half of the between-exact-seconds distance, it is recognizable that the lower-digit indication hand is on the forward route. On the other hand, when the second hand has advanced beyond the half of the between-exact-seconds distance, it is recognizable that the lower-digit indication hand is on the return route.

Accordingly, the value of the lower digit of the measured time can be indicated in a easily recognizable manner.

In the above time measurement device of the above aspect of the invention, the first drive controller preferably moves the higher-digit indication hand at a time interval equal to the half of the predetermined cycle.

According to the above arrangement, when the higher-digit indication hand is a second hand while the lower-digit indication hand indicates a digit of 1/10 seconds, the second hand moves at an interval of 0.5 seconds. With the above arrangement, when the second hand points at an exact-minute graduation, it is recognizable that the lower-digit indication hand is on the forward route. When the second hand points at a 0.5 second graduation, it is recognizable that the lower-digit indication hand is on the return route. Accordingly, the value of the lower digit of the measured time can be indicated in a easily recognizable manner.

Further, as compared to, for instance, an instance where the second hand moves at an interval of 0.2 seconds, the movement interval of the second hand can be lengthened, so that the power consumed by the time measurement device can be reduced.

In the above time measurement device of the above aspect of the invention, the second drive controller preferably reverses a movement direction of the lower-digit indication hand every 0.5 seconds or every one second.

With the above arrangement, since it takes one second for the lower-digit indication hand to reciprocate or move through one route (i.e. the forward route or the return route) of the lower-digit indication hand is one second, a user can determine the position of the lower-digit indication hand with reference to the distance per second, so that the user can easily recognize the measured time.

In the above time measurement device of the above aspect of the invention, the higher-digit indication hand is preferably a second hand.

According to the above arrangement, the lower-digit indication hand indicates a digit lower than a second (e.g. a digit of 1/10 seconds). In other words, the lower-digit indication hand reciprocates at a speed higher than the speed of the second hand. Accordingly, the reciprocating hand can be moved with a fast speed, so that the time measurement device can be made more attractive in design.

The above time measurement device of the above aspect of the invention preferably includes a digital display unit that is configured to display a numeral image to indicate a further higher digit of the measured time relative to the higher digit indicated by the higher-digit indication hand.

According to the above arrangement, when the higher-digit indication hand is, for instance, a second hand while the lower-digit indication hand indicates a digit of 1/10 seconds, a minute of the measured time can be displayed by the digital display unit. With the above arrangement, even when there is no space for providing a hand independent of the higher-digit indication hand and the lower-digit indication hand, the minute of the measured time can be displayed by the digital display unit, so that longer measured time can be displayed.

BRIEF DESCRIPTION OF THE DRAWING(S)

The invention will be described with reference to the accompanying drawings, wherein like numbers reference like elements.

FIG. 3 shows movement conditions of chronograph hands of the chronograph timepiece.

FIG. 4 shows output conditions of motor drive pulses of a 1/10-second-chronograph-hand drive controller of the chronograph timepiece.

DESCRIPTION OF EXEMPLARY EMBODIMENT(S)

Exemplary embodiment(s) of the invention will be described below with reference to the attached drawings.

Figure 1:
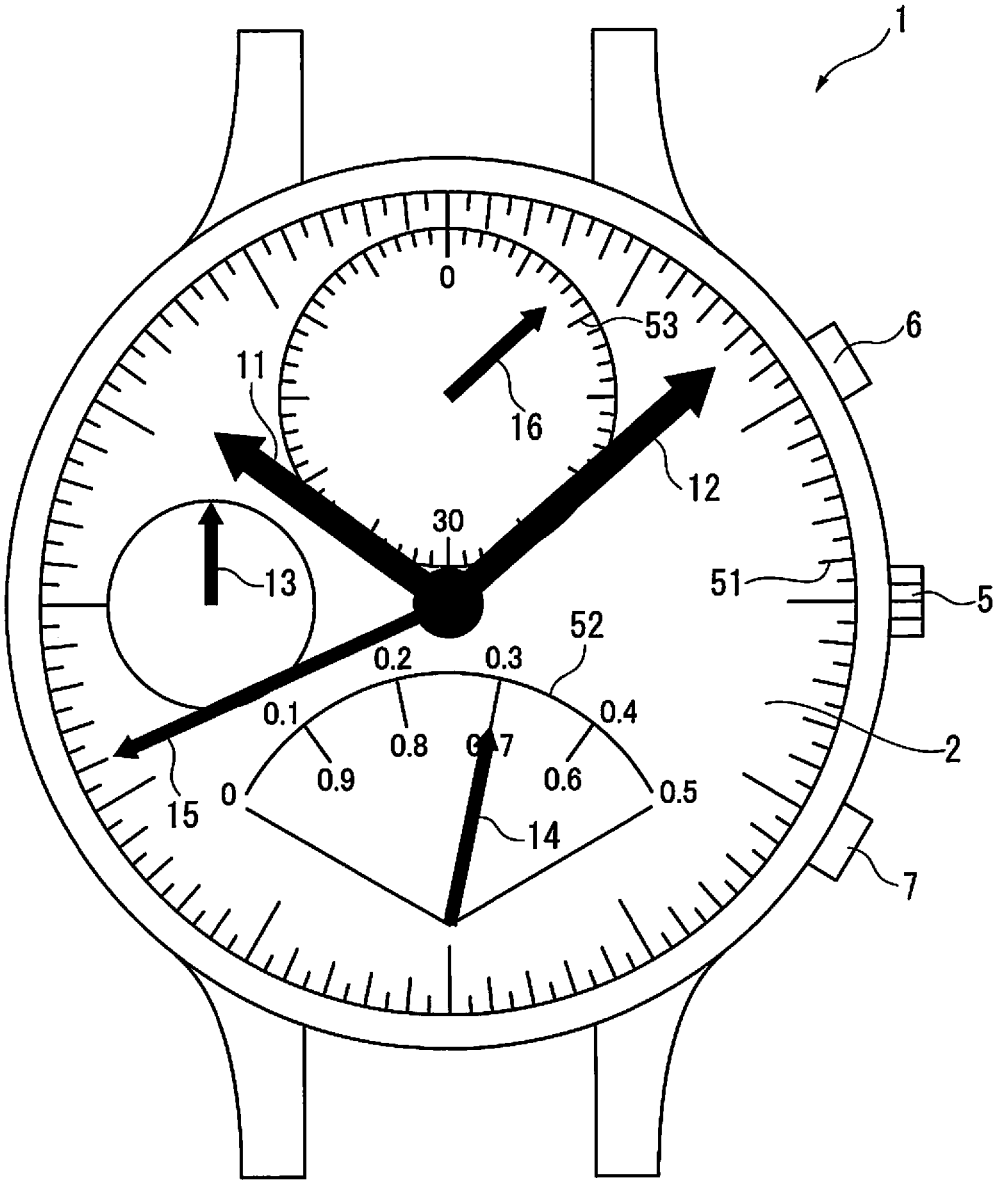
FIG. 1 is a front elevation showing a chronograph timepiece according to an exemplary embodiment of the invention.

FIG. 1 is a front elevation showing a chronograph timepiece 1.

As shown in FIG. 1, the chronograph timepiece 1 has basic timepiece hands for displaying time in a form of an hour hand 11, a minute hand 12, and a second hand 13. Rotary shafts of the hour hand 11 and the minute hand 12 are located at the center of a dial plate 2 in a plan view where a dial plate 2 of the chronograph timepiece 1 is seen from a front side. The second hand 13 is disposed at a position shifted from the center of the dial plate 2 in a 9 o'clock direction.

Further, the chronograph timepiece 1 includes chronograph hands for displaying the measured time, including a 1/10 second chronograph hand (lower-digit indication hand) 14, a chronograph second hand (higher-digit indication hand) 15, and a chronograph minute hand 16. The chronograph timepiece 1 defines the time measurement device of the invention.

The 1/10 second chronograph hand 14 displays a 1/10 second digit (lower digit) of the measured time. The chronograph second hand 15 displays a second digit (higher digit) of the measured time. The chronograph minute hand 16 displays a minute digit (further higher digit) of the measured time.

The rotary shaft of the 1/10 second chronograph hand 14 is disposed at a position shifted from the center of the dial plate 2 in a 6 o'clock direction. The rotary angle of the 1/10 second chronograph hand 14 is set within 180 degrees so that a movement area of the 1/10 second chronograph hand 14 is in a sectorial shape. The 1/10 second chronograph hand 14 is disposed such that the 1/10 second chronograph hand 14 is oriented in a 0 o'clock direction of the dial plate 2 when the 1/10 second chronograph hand 14 is at the center of the movement area. Further, the 1/10 second chronograph hand 14 alternately rotates clockwise and anticlockwise (i.e. reciprocates).

The rotary shaft of the chronograph second hand 15 is at the center of the dial plate 2 in the same manner as the hour hand 11 and the minute hand 12.

The chronograph minute hand 16 is disposed at a position shifted from the center of the dial plate 2 in the 0 o'clock direction.

Time/minute/second graduations 51 that divide the circumference of the dial plate 2 into 120 segments are provided on an outer periphery of the dial plate 2.

1/10 second graduations 52 that divide the movement area of the 1/10 second chronograph hand 14 into five segments are provided around the movement area of the 1/10 second chronograph hand 14. A character "0" indicating a 0.0 second position (1.0 second position) is provided at a clockwise start point (anticlockwise end point) of the 1/10 second graduations 52. A character "0.5" indicating a 0.5 second position is provided at a clockwise end point (anticlockwise start point) of the 1/10 second graduations 52.

Further, characters "0.1", "0.2", "0.3" and "0.4" respectively indicating a 0.1 second position, 0.2 second position, 0.3 second position and 0.4 second position are provided to the segments of the 1/10 second graduations 52 at a side toward 0 o'clock of the dial plate 2 in sequence from the 0 second position toward the 0.5 second position. Additionally, characters "0.6", "0.7", "0.8" and "0.9" respectively indicating a 0.6 second position, 0.7 second position, 0.8 second position and 0.9 second position are provided to the segments of the 1/10 second graduations 52 at a side toward 6 o'clock of the dial plate 2 in sequence from the 0.5 second position toward the 0 second position.

Minute graduations 53 that divide a circumference of a movement area of the chronograph minute hand 16 in the dial plate 2 into sixty segments are provided on a periphery of the movement area of the chronograph minute hand 16.

The chronograph timepiece 1 further includes a winding crown 5 (external operation member), and a first button 6 and a second button 7 (additional external operation members).

Figure 2:
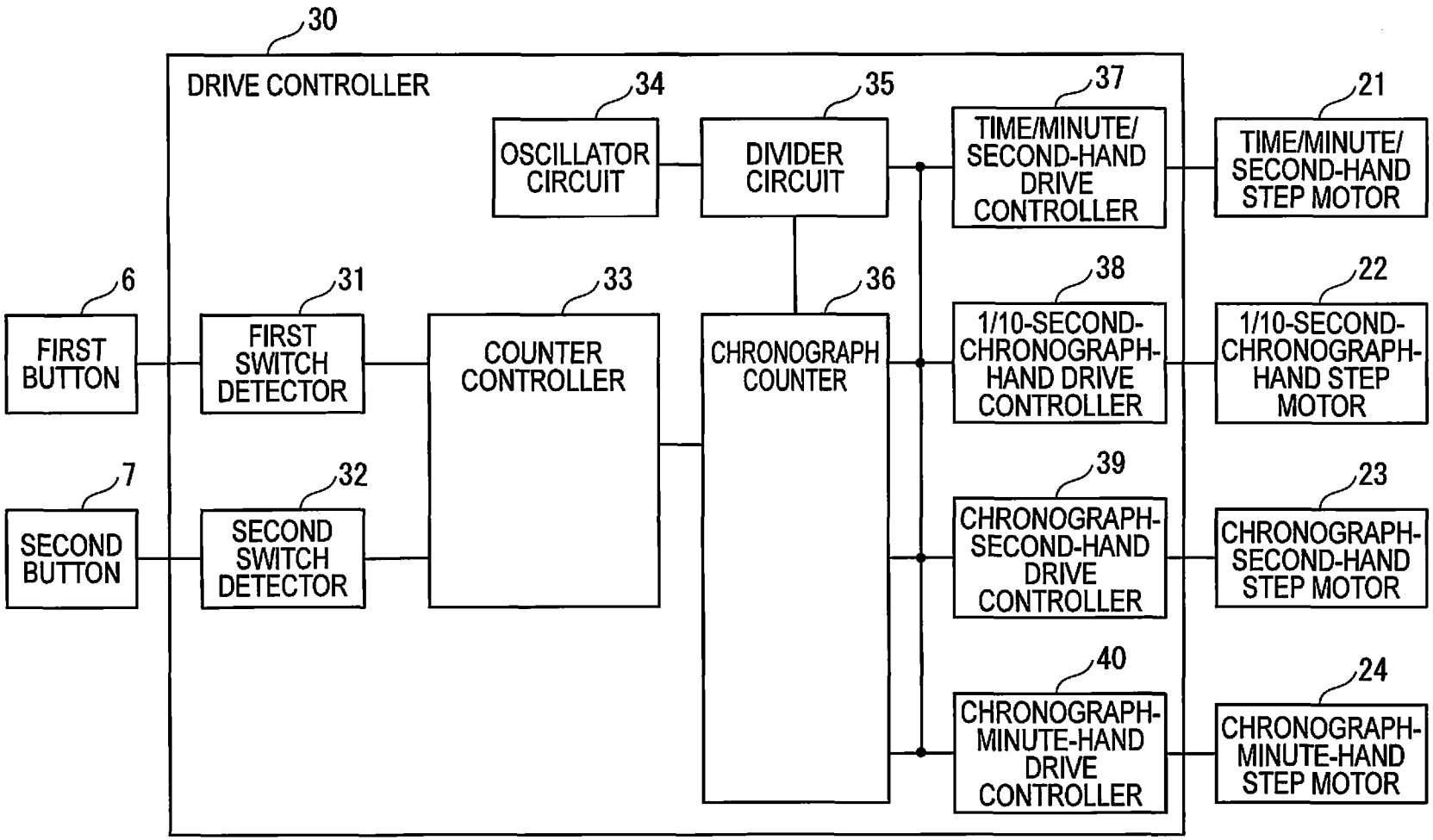
FIG. 2 is a block diagram showing an arrangement of the chronograph timepiece.

FIG. 2 is a block diagram showing an arrangement of the chronograph timepiece 1.

As shown in FIG. 2, the chronograph timepiece 1 includes four step motors for driving the hands 11 to 16. The hour hand 11, the minute hand 12 and the second hand 13 are driven by a time/minute/second-hand step motor 21. The 1/10 second chronograph hand 14 is driven by a 1/10-second-chronograph-hand step motor (second drive unit) 22. The chronograph second hand 15 is driven by a chronograph-second-hand step motor (first drive unit) 23. The chronograph minute hand 16 is driven by a chronograph-minute-hand step motor 24.

In order to control the drive of the step motors 21 to 24, the chronograph timepiece 1 is provided therein with a drive controller 30.

The drive controller 30 includes a first switch detector 31, a second switch detector 32, a counter controller 33, an oscillator circuit 34, a divider circuit 35, a chronograph counter (time counter) 36, a time/minute/second-hand drive controller 37, a 1/10-second-chronograph-hand drive controller (second drive controller) 38, a chronograph-second-hand drive controller (first drive controller) 39, and a chronograph-minute-hand drive controller 40.

The first switch detector 31 detects a press operation of the first button 6 and, when the press operation is detected, outputs a detection signal therefor to the counter controller 33.

The second switch detector 32 detects a press operation of the second button 7 and, when the press operation is detected, outputs a detection signal therefor to the counter controller 33.

The counter controller 33 outputs a control signal to the chronograph counter 36 in response to the output signal(s) from the first switch detector 31 and the second switch detector 32.

The oscillator circuit 34 includes a quartz oscillator and the like to output a reference clock signal of 32.768 kHz.

The divider circuit 35 divides frequencies of the reference clock signal outputted from the oscillator circuit 34 and outputs the divided frequencies to the chronograph counter 36, the time/minute/second-hand drive controller 37, the 1/10-second-chronograph-hand drive controller 38, the chronograph-second-hand drive controller 39, and the chronograph-minute-hand drive controller 40.

The chronograph counter 36 counts the reference clock signal outputted from the divider circuit 35 in response to the control signal outputted from the counter controller 33 to measure an elapsed time. Then, the chronograph counter 36 outputs the counted value to the time/minute/second-hand drive controller 37, the 1/10-second-chronograph-hand drive controller 38, the chronograph-second-hand drive controller 39, and the chronograph-minute-hand drive controller 40.

The time/minute/second-hand drive controller 37 outputs a motor drive pulse using the reference clock signal outputted from the divider circuit 35 and controls the drive of the hour hand 11, the minute hand 12 and the second hand 13 through the time/minute/second-hand step motor 21.

In other words, the time/minute/second-hand drive controller 37 displays hour, minute and second of the time using the hour hand 11, the minute hand 12, and the second hand 13.

The 1/10-second-chronograph-hand drive controller 38 outputs a motor drive pulse in accordance with the counted value outputted by the chronograph counter 36 using the reference clock signal outputted by the divider circuit 35 to control the drive of the 1/10 second chronograph hand 14 through the 1/10-second-chronograph-hand step motor 22.

In other words, when the chronograph counter 36 starts measuring the elapsed time, the 1/10-second-chronograph-hand drive controller 38 rotates (reciprocates) the 1/10 second chronograph hand 14 alternately clockwise and anticlockwise to display the one-tenth second digit of the measured time.

The chronograph-second-hand drive controller 39 outputs the motor drive pulse in accordance with the counted value outputted by the chronograph counter 36 using the reference clock signal outputted by the divider circuit 35 to control the drive of the chronograph second hand 15 through the chronograph-second-hand step motor 23.

In other words, when the chronograph counter 36 starts measuring the elapsed time, the chronograph-second-hand drive controller 39 rotates the chronograph second hand 15 clockwise to display the second of the measured time.

The chronograph-minute-hand drive controller 40 outputs the motor drive pulse in accordance with the counted value outputted by the chronograph counter 36 using the reference clock signal outputted by the divider circuit 35 to control the drive of the chronograph minute hand 16 through the chronograph-minute-hand step motor 24.

In other words, when the chronograph counter 36 starts measuring the elapsed time, the chronograph-minute-hand drive controller 40 rotates the chronograph second hand 16 clockwise to display the minute of the measured time.

FIG. 3 shows movement conditions of the chronograph hands.

As shown in FIG. 3, the display unit of the 1/10 second chronograph hand 14 is 1/10 seconds (0.1 seconds). Specifically, the 1/10 second chronograph hand 14 moves clockwise every 1/10 seconds and, when 0.5 seconds elapses, the 1/10 second chronograph hand 14 reverses the rotary direction thereof to move anticlockwise every 1/10 seconds. The number of steps for one route is 20. In other words, the number of steps of the chronograph second hand 15 per one hand movement is 4. Further, the measured time corresponding to each reciprocatory motion of the chronograph second hand 15 is one second. In other words, the 1/10 second chronograph hand 14 reciprocates in one second.

The display unit of the chronograph second hand 15 is 1/2 seconds (0.5 seconds). In other words, the chronograph second hand 15 moves clockwise every 0.5 seconds. The number of steps of the chronograph second hand 15 for one rotation is 120. In other words, the number of steps of the chronograph second hand 15 per one hand movement is 1. Further, the measured time corresponding to each reciprocatory motion of the chronograph second hand 15 is sixty seconds.

The display unit of the chronograph minute hand 16 is one minute. In other words, the chronograph minute hand 16 moves every one minute. The number of steps of the chronograph minute hand 16 for one route is 60. In other words, the number of steps of the chronograph minute hand 16 per one hand movement is 1. Further, the measured time corresponding to each reciprocatory motion of the chronograph minute hand 16 is sixty minutes.

FIG. 4 shows output conditions of the motor drive pulses of the 1/10-second-chronograph-hand drive controller 38.

As shown in FIG. 4, the 1/10-second-chronograph-hand drive controller 38 outputs four clockwise drive pulses for rotating clockwise (i.e. to the right) the 1/10 second chronograph hand 14 to the 1/10-second-chronograph-hand step motor 22 when the counted value of the chronograph counter 36 reaches 0.1 seconds, 0.2 seconds, 0.3 seconds, 0.4 seconds, and 0.5 seconds.

Similarly, the 1/10-second-chronograph-hand drive controller 38 outputs four anticlockwise drive pulses for rotating anticlockwise (i.e. to the left) the 1/10 second chronograph hand 14 to the 1/10-second-chronograph-hand step motor 22 when the counted value of the chronograph counter 36 reaches 0.6 seconds, 0.7 seconds, 0.8 seconds, 0.9 seconds, and 0 seconds.

Chronographic Operation

Next, a chronographic operation will be described below.

Figure 5:
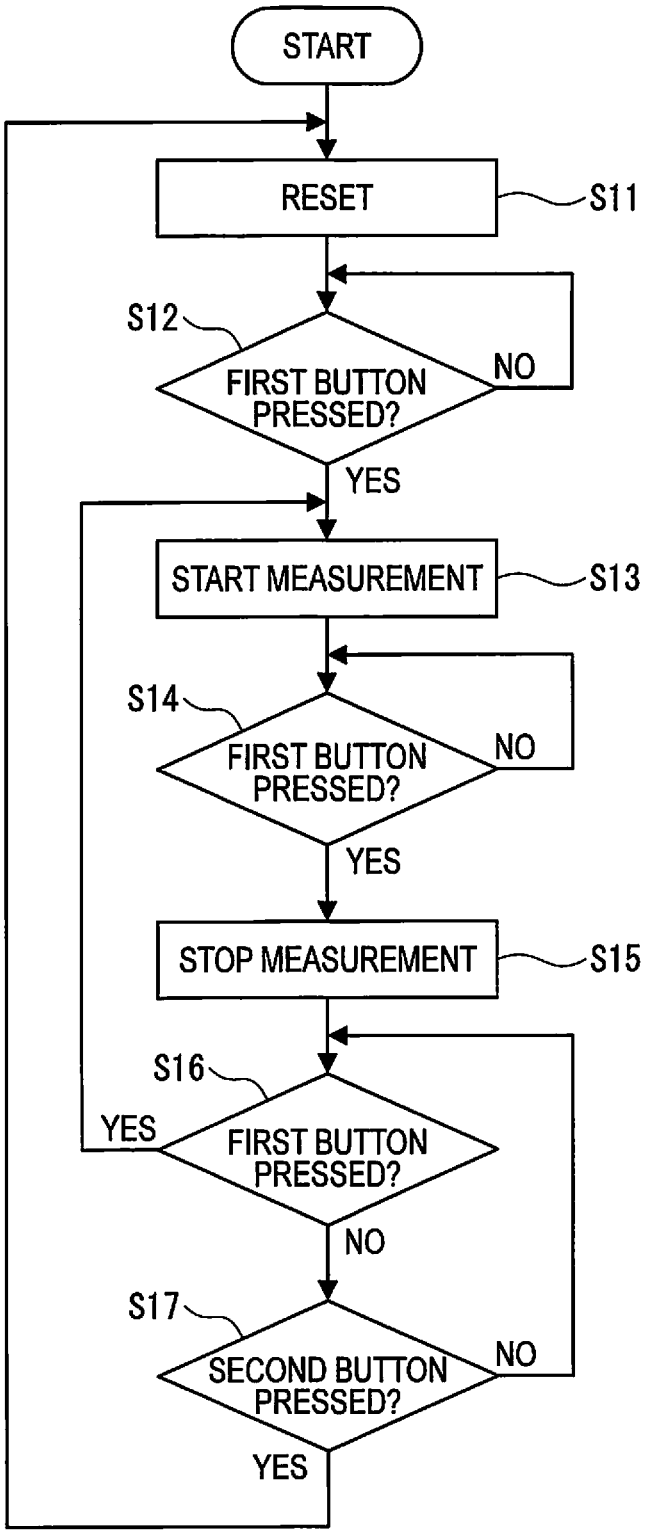
FIG. 5 is a flow chart showing a chronographic operation of the chronograph timepiece.

FIG. 5 is a flow chart showing the chronographic operation.

The operation shown in FIG. 5 starts when, for instance, a chronograph mode is selected through a mode switch operation on the second button 7.

Initially, the counter controller 33 outputs a reset signal to the chronograph counter 36 to reset the counted value of the chronograph counter 36 (S11). The condition of each of the hands at this time is illustrated in FIG. 6.

Figure 6:
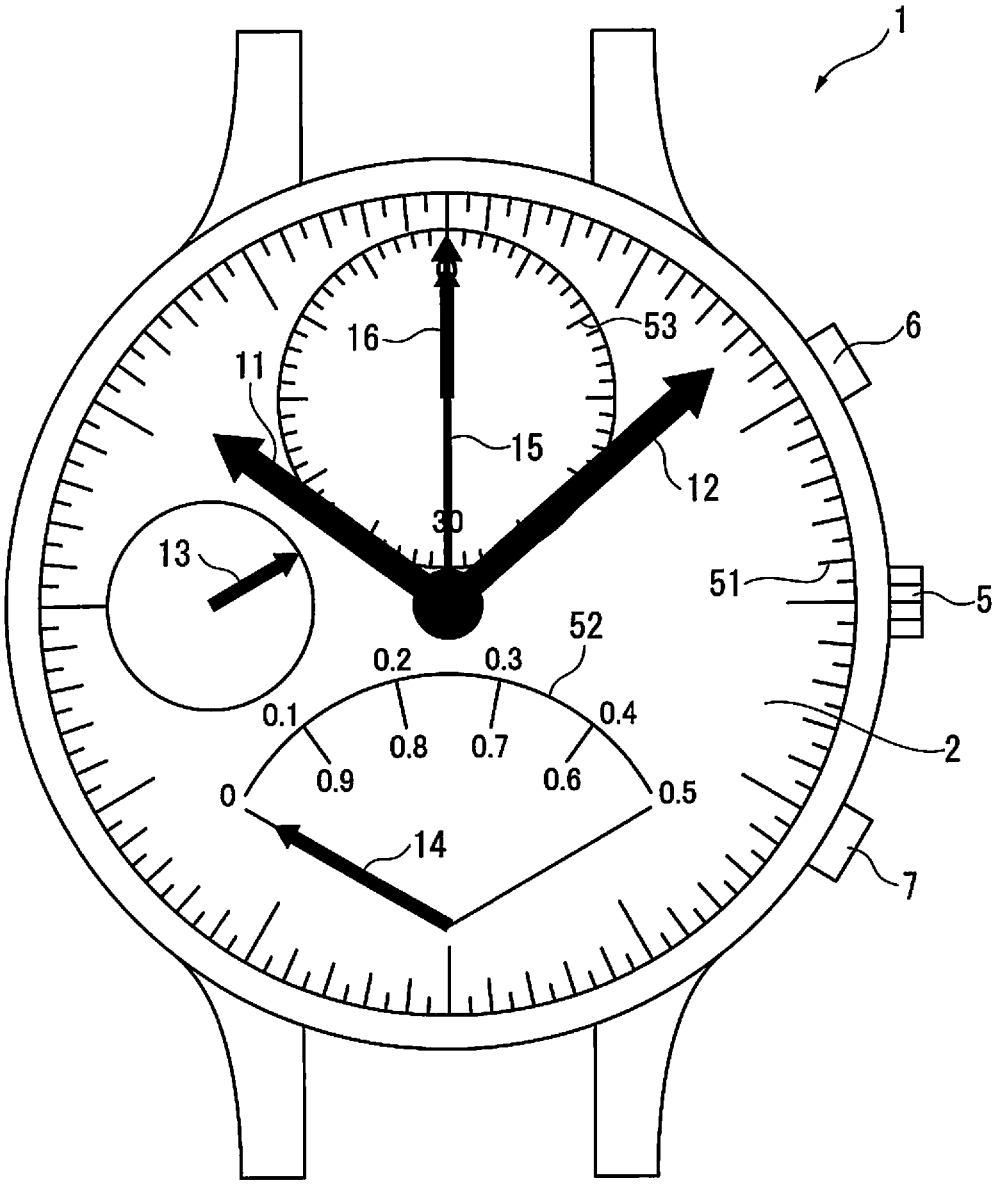
FIG. 6 is an illustration showing an example of a display of the chronograph timepiece when the chronograph timepiece is reset.

As shown in FIG. 6, the hour hand 11, the minute hand 12, and the second hand 13 respectively indicate hour, minute and second of the current time. The 1/10 second chronograph hand 14 points at the 0.0 second position. The chronograph second hand 15 points at the 0 second position. The chronograph minute hand 16 points at a 0-minute position.

Next, the counter controller 33 detects the output signal of the first switch detector 31 to determine whether the first button 6 is pressed or not (S12).

When the determination result is NO in S12, the counter controller 33 repeats the judgment in S12.

When the determination result is YES in S12, the counter controller 33 outputs a measurement start signal to the chronograph counter 36. Then, the chronograph counter 36 starts measuring the time elapsed since the first button 6 is pressed in S12 (S13).

In conjunction with the above operation, the 1/10-second-chronograph-hand drive controller 38, the chronograph-second-hand drive controller 39 and the chronograph-minute-hand drive controller 40 respectively drive the 1/10-second-chronograph-hand step motor 22, the chronograph-second-hand step motor 23, and the chronograph-minute-hand step motor 24. Then, the 1/10 second chronograph hand 14 alternately rotates clockwise and anticlockwise (i.e. to reciprocate). The chronograph second hand 15 and the chronograph minute hand 16 rotate clockwise to display the measured time. The condition of each of the hands during the measurement is illustrated in FIGS. 7 to 10.

Figure 7:
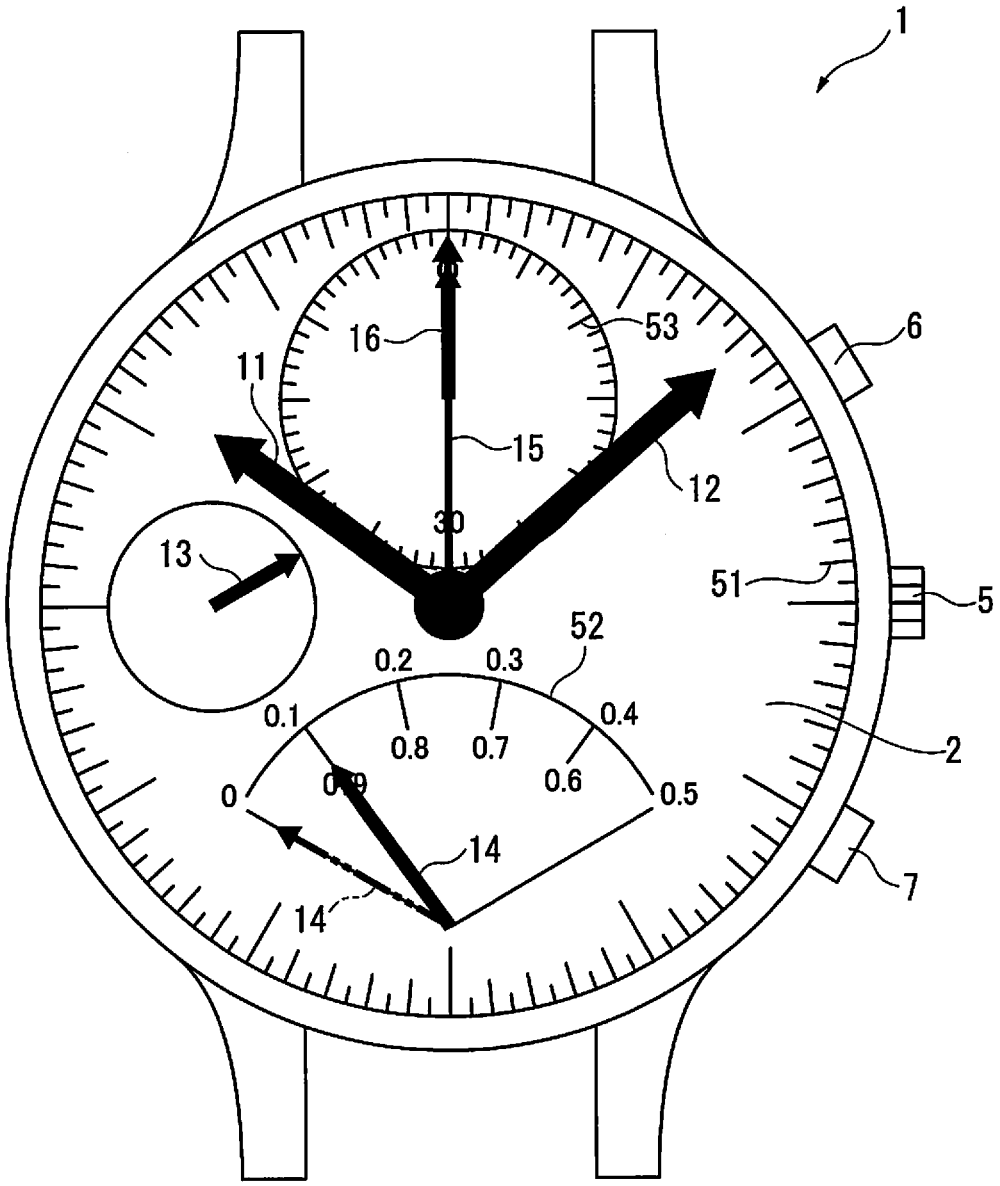
FIG. 7 is an illustration showing the example of the display of the chronograph timepiece during the measurement.

When the measurement is started, the 1/10 second chronograph hand 14 moves clockwise at an interval of 1/10 seconds (0.1 seconds). FIG. 7 shows an example of the display when the measured time is 0.1 seconds. The 1/10 second chronograph hand 14 points at the 0.1 second position in the 1/10 second graduations 52. At this time, the chronograph second hand 15 points at the 0 second position.

Figure 8:
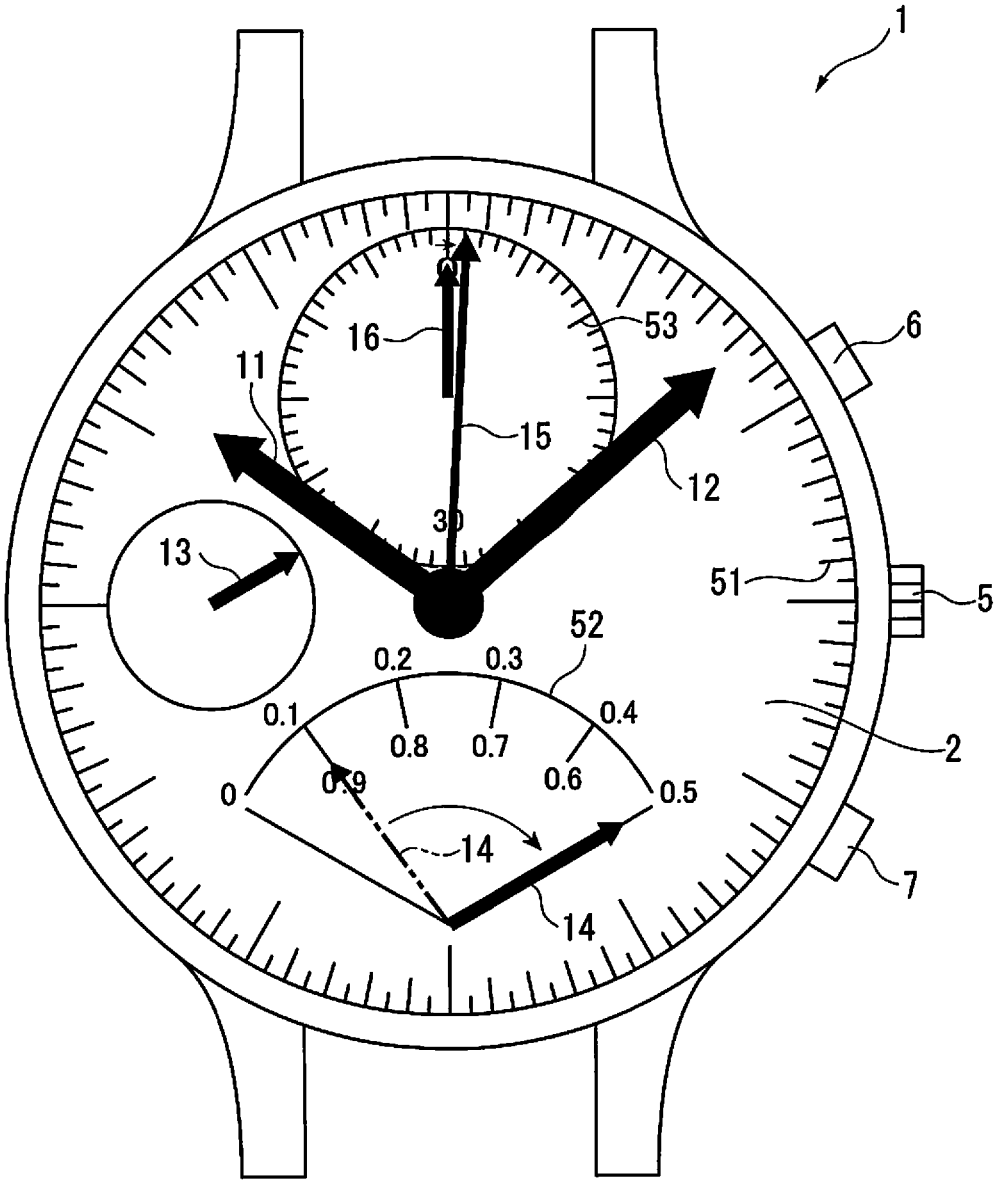
FIG. 8 is another illustration showing the example of the display of the chronograph timepiece during the measurement.

When the measured time reaches 0.5 seconds and the 1/10 second chronograph hand 14 points at the 0.5 second position in the 1/10 second graduations 52 as shown in FIG. 8, the chronograph second hand 15 moves to point at the 0.5 second position in the time/minute/second graduations 51.

Figure 9:
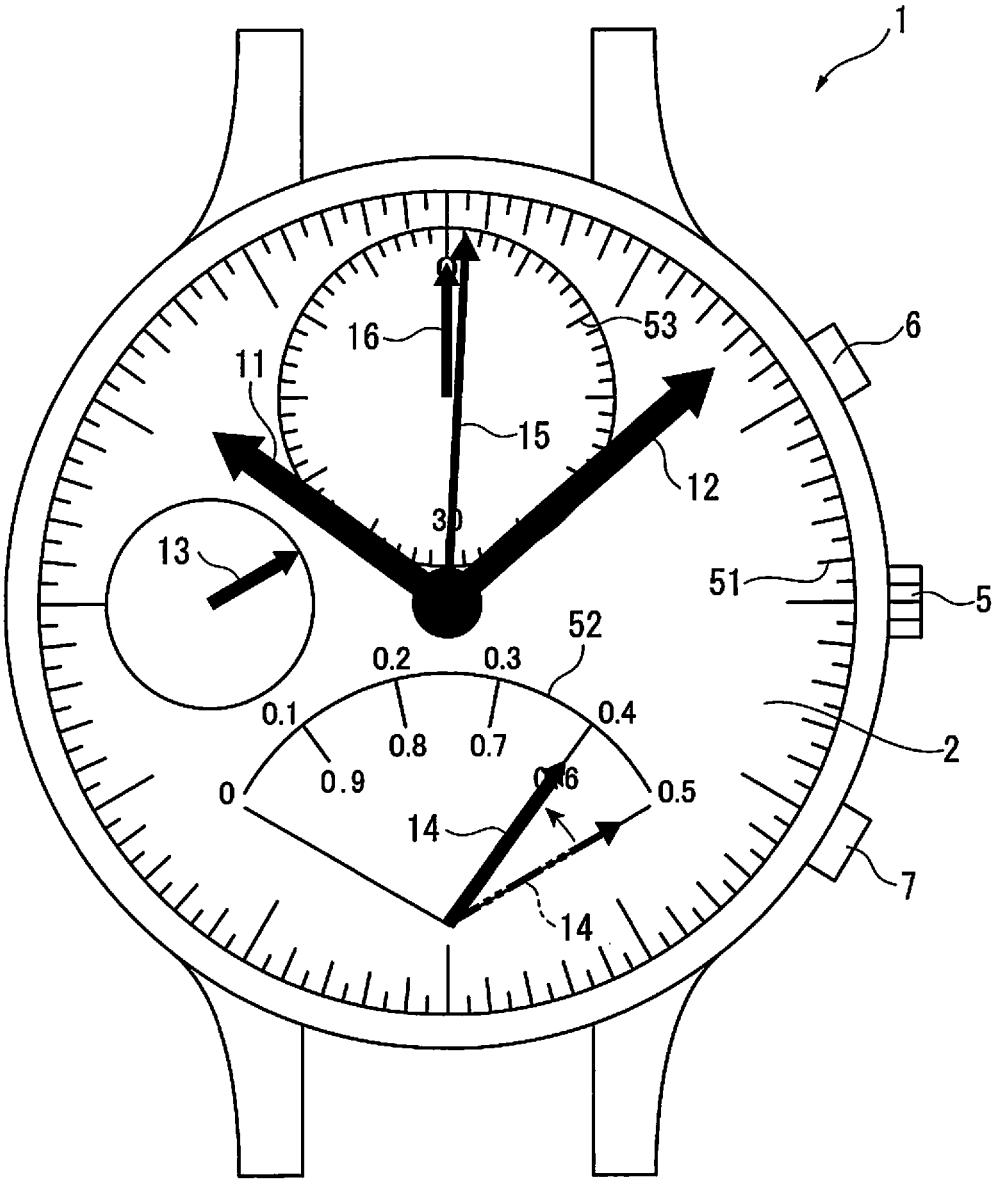
FIG. 9 is still another illustration showing the example of the display of the chronograph timepiece during the measurement.

Subsequently, the 1/10 second chronograph hand 14 moves anticlockwise at an interval of 1/10 seconds. FIG. 9 shows an example of the display when the measured time is 0.6 seconds. The 1/10 second chronograph hand 14 points at 0.6 second position of the 1/10 second graduations 52. At this time, the chronograph second hand 15 continuously points at the 0.5 second position.

Figure 10:
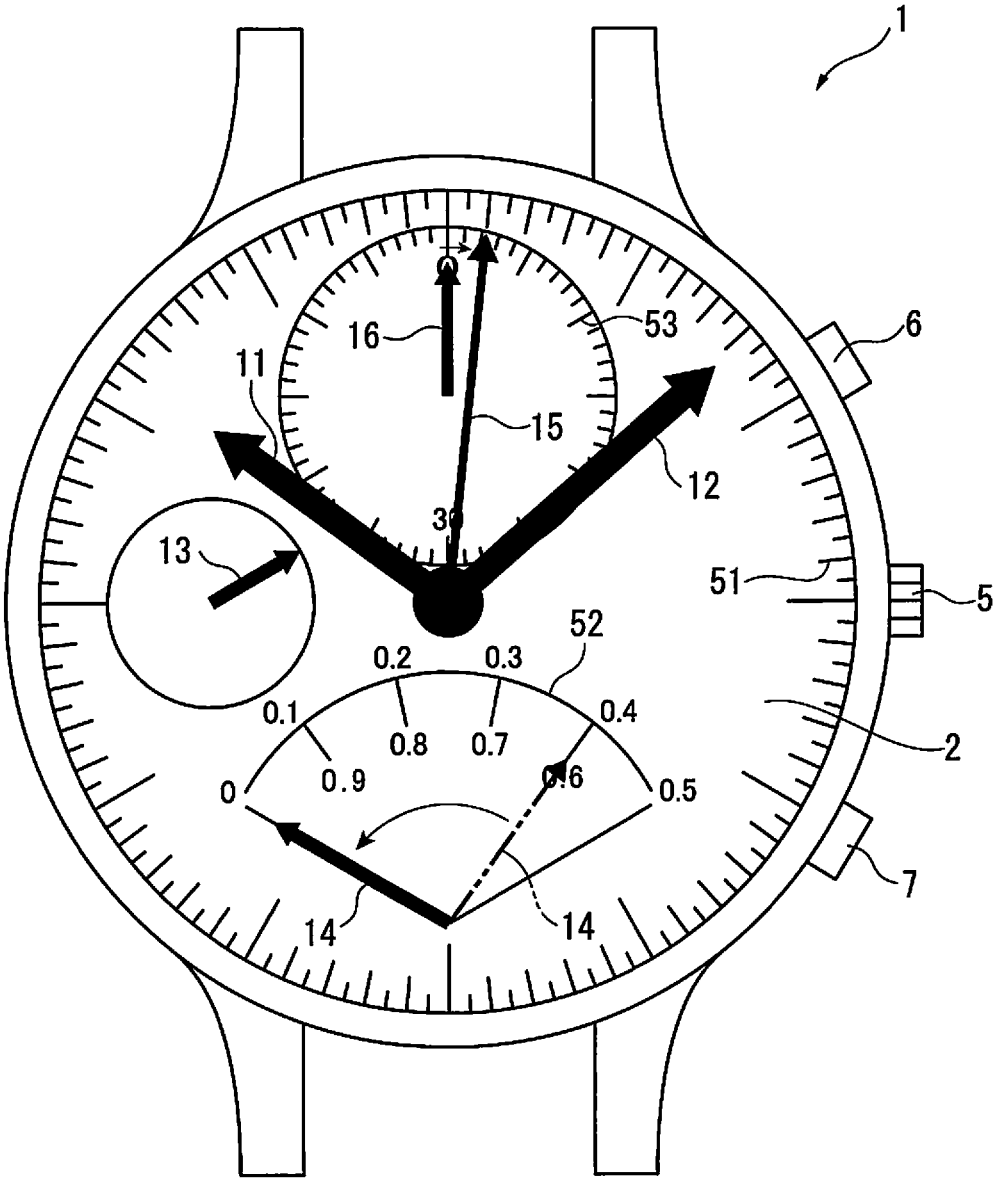
FIG. 10 is a further illustration showing the example of the display of the chronograph timepiece during the measurement.

When the measured time reaches 1 second and the 1/10 second chronograph hand 14 points at the 1.0 (0.0) second position in the 1/10 second graduations 52 as shown in FIG. 10, the chronograph second hand 15 moves to point at the 1 second position in the time/minute/second graduations 51.

The 1/10 second chronograph hand 14 repeats the above reciprocatory motion with a period of one second. The chronograph second hand 15 moves each time the 1/10 second chronograph hand 14 points at the 0.5 second position or the 0 second position. In other words, the chronograph second hand 15 moves at an interval of 0.5 seconds.

When the measured time reaches one minute and the chronograph second hand 15 makes a full circle, the chronograph minute hand 16 moves.

After S13, the counter controller 33 detects the output signal of the first switch detector 31 to determine whether the first button 6 is pressed again or not (S14).

When the determination result is NO in S14, the counter controller 33 repeats the judgment of S14.

On the other hand, when the determination result is YES in S14, the counter controller 33 outputs a measurement end signal to the chronograph counter 36. The chronograph counter 36 then stops the measurement of the elapsed time (S15).

Specifically, at this time, the 1/10 second chronograph hand 14 indicates the 1/10 second digit of the time elapsed since the first button 6 is initially pressed until the first button 6 is pressed again, the chronograph second hand 15 indicates the second of the elapsed time, and the chronograph minute hand 16 indicates the minute of the elapsed time.

Figure 11:
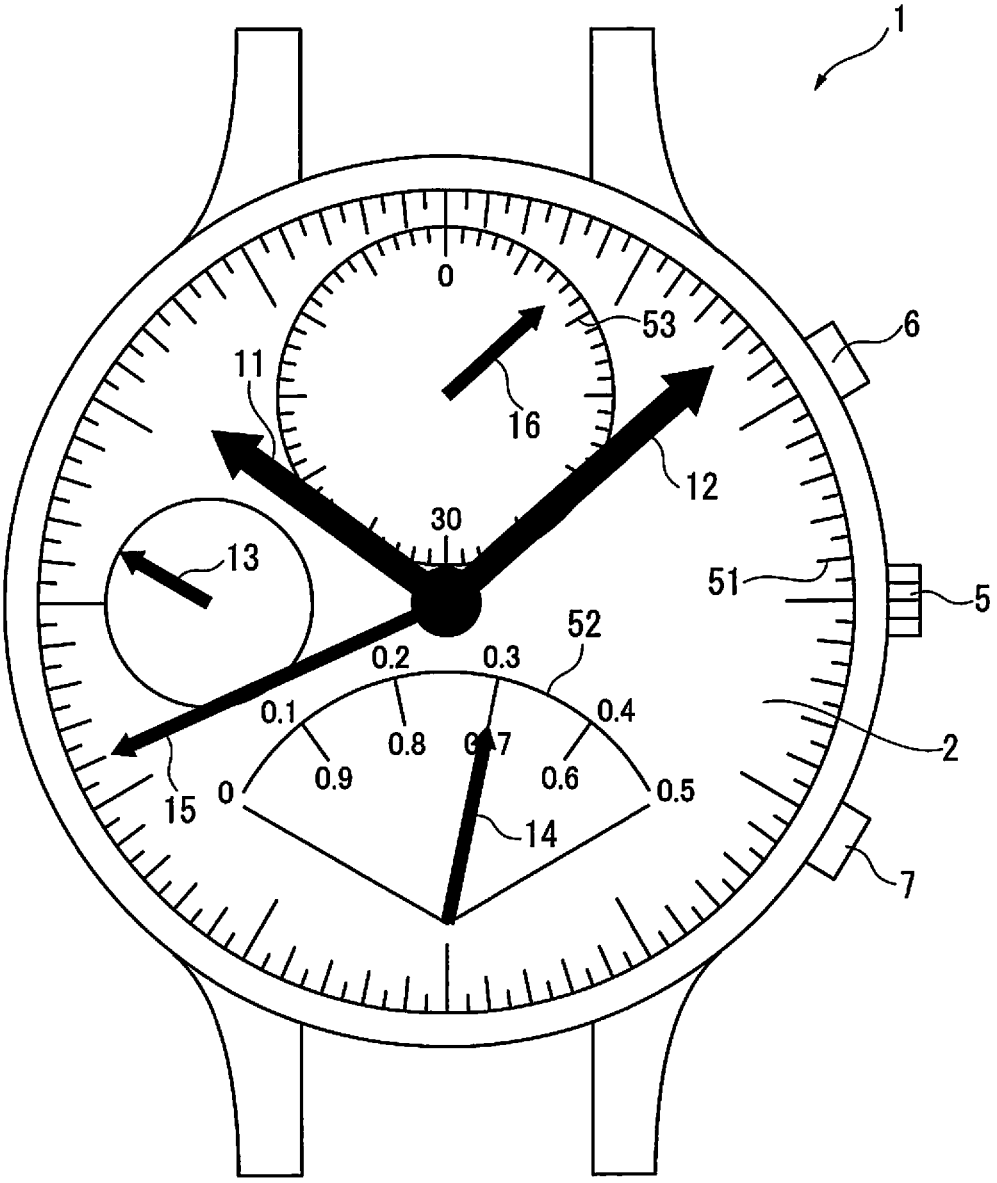
FIG. 11 is an illustration showing the example of the display of the chronograph timepiece after completion of the measurement.
Figure 12:
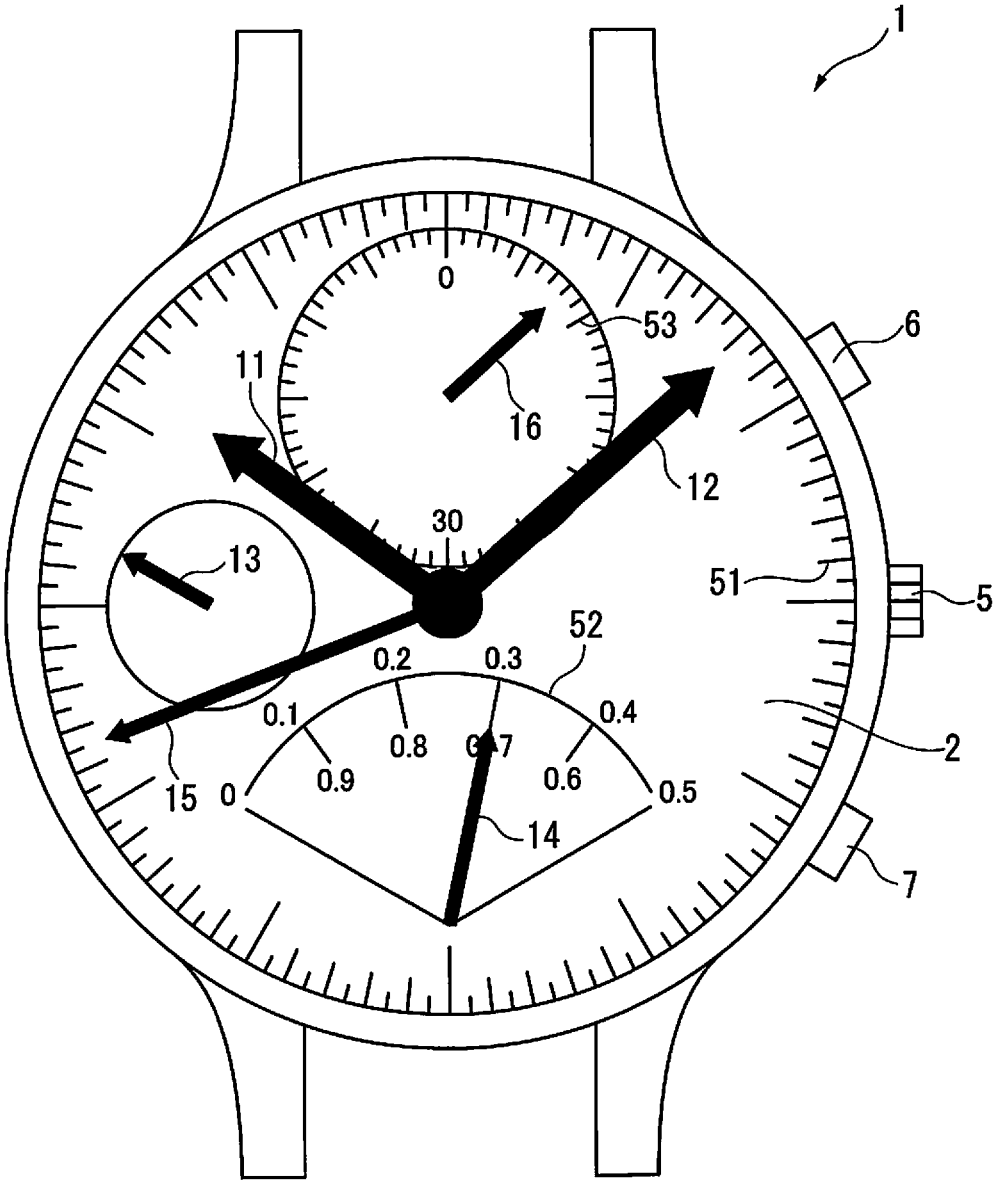
FIG. 12 is another illustration showing the example of the display of the chronograph timepiece after completion of the measurement.

FIGS. 11 and 12 are each an illustration showing an example of the display of the chronograph timepiece 1 after the completion of the measurement.

FIG. 11 is an example of the display when the measured time is 8 minutes 41.3 seconds.

The 1/10 second chronograph hand 14 points at the 0.3 second (0.7 second) position, the chronograph second hand 15 points at the 41 second position and the chronograph minute hand 16 points at the 8-minute position.

Since the 0.3 second index and the 0.7 second index are located at the same place in the 1/10 second graduations 52, it cannot be determined whether the 1/10 second chronograph hand 14 indicates 0.3 seconds or 0.7 seconds simply by viewing the 1/10 second chronograph hand 14.

In contrast, the chronograph second hand 15 of the chronograph timepiece 1 points at a graduation of exact second when the 1/10 second digit of the measured time is in a range from 0.0 seconds to 0.5 seconds. Further, the chronograph second hand 15 points at a graduation of 0.5 seconds (i.e. between exact seconds) when the 1/10 second digit of the measured time is in a range from 0.5 seconds to 1.0 (0.0) second.

Accordingly, it is recognizable that: when the chronograph second hand 15 points at a graduation of exact second, the 1/10 second chronograph hand 14 indicates a time in a range from 0.0 seconds to 0.5 seconds; and, when the chronograph second hand 15 points at a graduation of 0.5 seconds, the 1/10 second chronograph hand 14 indicates a time in a range from 0.5 seconds to 1.0 second (0.0 seconds).

In the example shown in FIG. 11, since the chronograph second hand 15 points at the 41 second graduation (i.e. a graduation of exact second), it can be determined that the 1/10 second chronograph hand 14 indicates a time in a range from 0.0 seconds to 0.5 seconds. Accordingly, it is recognizable that the 1/10 second chronograph hand 14 indicates 0.3 seconds.

FIG. 12 is an example of the display when the measured time is 8 minutes 41.7 seconds.

The 1/10 second chronograph hand 14 points at 0.3 second (0.7 second) position, the chronograph second hand 15 points at 41.5 second position and the chronograph minute hand 16 points at 8-minute position.

In the example shown in FIG. 12, since the chronograph second hand 15 points at the 41.5 second graduation, it can be determined that the 1/10 second chronograph hand 14 indicates a time in a range from 0.5 seconds to 1.0 (0.0) second. Accordingly, it is recognizable that the 1/10 second chronograph hand 14 indicates 0.7 seconds.

Next, the counter controller 33 judges the output signal of the first switch detector 31 to determine whether the first button 6 is pressed or not (S16).

When the determination result is YES in S16, the counter controller 33 repeats the process from S13.

When the determination result is NO in S16, the counter controller 33 detects the output signal of the second switch detector 32 to determine whether the second button 7 is pressed or not (S17).

When the determination result is NO in S17, the counter controller 33 repeats the process from S16.

On the other hand, when the determination result is YES in S17, the counter controller 33 repeats the process from S11.

Advantage(s) of Exemplary Embodiment(s)

Since the 1/10 second chronograph hand 14 indicates the measured time on the forward route and the return route, in other words, since the time required for returning the hand to a start position is not necessary unlike in an instance where the measured time is indicated solely on the forward route, the time indicated by the 1/10 second chronograph hand 14 and the measured time can be always the same.

Accordingly, the value of the 1/10 second digit of the measured time can be quickly indicated after the completion of the measurement.

The chronograph-second-hand drive controller 39 moves the chronograph second hand 15 at a time interval (0.5 seconds) that is half of the reciprocatory motion period (one second) of the 1/10 second chronograph hand 14.

Accordingly, it is recognizable that: the 1/10 second chronograph hand 14 is on the forward route when the chronograph second hand 15 points at a graduation of exact second; and the 1/10 second chronograph hand 14 is on the return route when the chronograph second hand 15 points at a graduation of 0.5 seconds. Thus, the value of the 1/10 second digit of the measured time can be indicated in a easily recognizable manner.

Further, as compared to an instance where the chronograph second hand 15 moves at, for instance, an interval of 0.2 seconds, the movement interval of the chronograph second hand 15 can be lengthened, so that the power consumed by the chronograph timepiece 1 can be reduced.

The chronograph-second-hand drive controller 39 reverses the movement direction of the 1/10 second chronograph hand 14 every 0.5 seconds.

With the above arrangement, since the time required for one reciprocatory motion of the 1/10 second chronograph hand 14 is one second, a user can determine the position of the 1/10 second chronograph hand 14 with reference to the distance per one second, so that the user can easily recognize the measured time.

The second of the measured time is indicated by the chronograph second hand 15 and the 1/10 second digit of the measured time is indicated by the 1/10 second chronograph hand 14. In other words, the 1/10 second chronograph hand 14 reciprocates at a speed faster than the speed of the chronograph second hand 15. Accordingly, the reciprocating hand can move with a fast speed, so that the chronograph timepiece 1 can be made more attractive in design.

The forward-route indexes and the return-route indexes of the 1/10 second graduations 52 are overlapped in the direction pointed by the 1/10 second chronograph hand 14.

Accordingly, as compared with an instance where the forward-route indexes and the return-route indexes are shifted in the direction to be pointed by the 1/10 second chronograph hand 14, the intervals between the indexes in the movement direction of the 1/10 second chronograph hand 14 can be widened. Accordingly, it is easily recognizable whether the 1/10 second chronograph hand 14 points at one of the forward-route indexes or one of the return-route indexes.

Modification(s)

It should be noted that the scope of the invention is not limited to the above-described exemplary embodiment but encompasses various modifications as long as such modifications are compatible with the invention.

For instance, though the chronograph-second-hand drive controller 39 moves the chronograph second hand 15 at a time interval (0.5 seconds) that is half of the reciprocatory motion period (one second) of the 1/10 second chronograph hand 14 in the above exemplary embodiment, such an arrangement is not requisite for the invention. It is only required for the chronograph-second-hand drive controller 39 to move the chronograph second hand 15 at a time interval (e.g. 0.2 seconds) that is not more than a half of the reciprocatory motion period of the 1/10 second chronograph hand 14.

In the above arrangement, supposing that a distance between exact second positions of the time/minute/second graduations 51 is defined as a between-exact-seconds distance, when the chronograph second hand 15 does not reach a half of the between-exact-seconds distance, it is recognizable that the 1/10 second chronograph hand 14 is on the forward route. On the other hand, when the chronograph second hand 15 has advanced beyond the half of the between-exact-seconds distance, it is recognizable that the 1/10 second chronograph hand 14 is on the return route.

Though the period of one reciprocatory motion of the 1/10 second chronograph hand 14 is one second in the above exemplary embodiment, such an arrangement is not requisite for the invention. For instance, the movement direction may be reversed every second to set the period at two seconds. At this time, the chronograph second hand 15, for instance, moves at an interval of one second.

Whether the 1/10 second chronograph hand 14 is on the forward route or on the return route can be determined by judging whether the chronograph second hand 15 points at an odd-number exact second position or at an even-number exact second position.

With the above arrangement, since it is only required for the chronograph second hand 15 to move at an interval of one second, the position of the chronograph second hand 15 can be more easily recognizable as compared to an instance where the chronograph second hand 15 moves at an interval of 0.5 seconds.

Further, since the measured time corresponding to one route (i.e. the forward route or the return route) is one second, the position indicated by the 1/10 second chronograph hand 14 can be determined with reference to the distance per second, so that the measured time can be easily recognized.

In the above exemplary embodiment, the chronograph second hand 15 (higher-digit indication hand) indicates the second of the measured time whereas the 1/10 second chronograph hand 14 (lower-digit indication hand) indicates the 1/10 second digit of the measured time. However, the higher digit indicated by the higher-digit indication hand and the lower digit indicated by the lower-digit indication hand of the invention are not limited thereto.

Specifically, as long as it is determinable whether the lower-digit indication hand is on the forward route or on the return route with reference to the difference in the position pointed by the higher-digit indication hand, the higher digit indicated by the higher-digit indication hand and the lower digit indicated by the lower-digit indication hand may be determined as desired.

For instance, the lower-digit indication hand may indicate the digit of the 1/5 seconds, 1/20 seconds or 1/100 seconds of the measured time.

Alternatively, the higher-digit indication hand may indicate the minute of the measured time and the lower-digit indication hand may indicate the second of the measured time. In this case, the lower-digit indication hand reciprocates in one minute period and the higher-digit indication hand moves at an interval of 30 seconds.

With the above arrangement, when the higher-digit indication hand points at an exact-minute graduation, it is recognizable that the lower-digit indication hand is on the forward route. When the higher-digit indication hand points at a thirty second graduation located between adjacent ones of the exact-minute graduations, it is recognizable that the lower-digit indication hand is on the return route.

Figure 13:
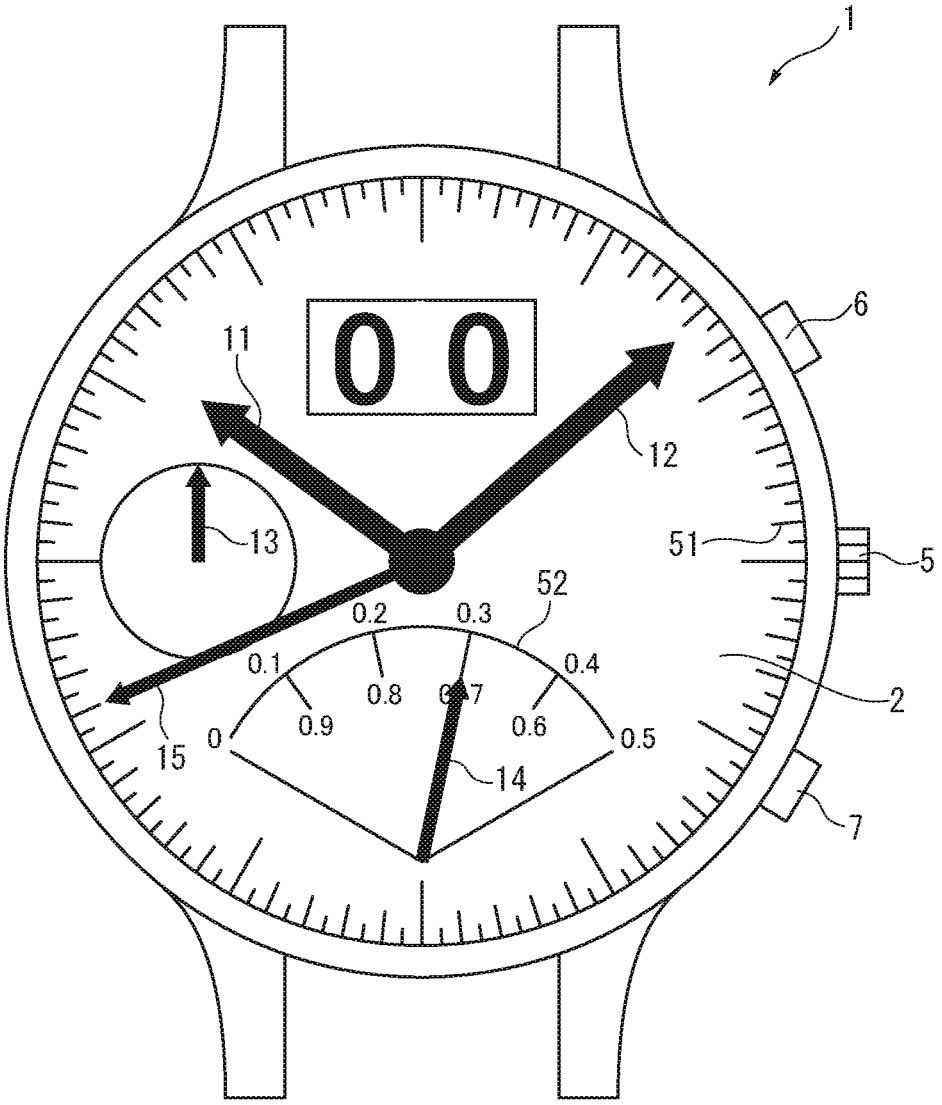
FIG. 13 is an illustration showing a chronograph timepiece with a digital display unit.

Though the minute of the measured time is indicated by the chronograph minute hand 16 in the above exemplary embodiment, the minute may be indicated by a digital display unit including a liquid crystal display panel or the like for displaying a numeral image, as shown in FIG. 13.

With the above arrangement, even when there is no space for the chronograph minute hand 16, the minute of the measured time can be displayed by the digital display unit, so that longer measured time can be displayed.

In the above arrangement, when, for instance, the second button 7 is pressed after starting the measurement of the elapsed time in S13 and before the measurement is ended in S15, the measured time at the time when the second button 7 is pressed may be indicated by the chronograph hands while continuing the measurement (split function).

Though the 1/10 second chronograph hand 14 alternately moves clockwise and anticlockwise (i.e. reciprocates) around an end of the 1/10 second chronograph hand 14 within a sectoral region (sectoral reciprocatory motion) in the above exemplary embodiment, the 1/10 second chronograph hand 14 may be sequentially slid in right and left directions to linearly reciprocate.

Though the time measurement device in the above exemplary embodiment is the chronograph timepiece 1, the time measurement device of the invention is not limited to a timepiece. Specifically, the time measurement device may be a product that is not a timepiece, such as a stop watch.

What is claimed is:

1. A time measurement device, comprising:

a first indication hand that is configured to indicate a digit of a measured time;

a second indication hand that is configured to reciprocate in a movement area, and is configured to indicate a lower digit of the measured time than the first indication hand by pointing at graduations provided around the movement area on a forward route and on a return route, the same graduations being used to indicate the lower digit of the measured time on both the forward route and the return route;

a first drive unit that is configured to drive the first indication hand;

a second drive unit that is configured to drive the second indication hand;

a time counter that is configured to measure a time;

a first drive controller that is configured to control the first drive unit to drive the first indication hand based on the measured time measured by the time counter; and a second drive controller that is configured to control the second drive unit to drive the second indication hand based on the measured time measured by the time counter, the second drive controller reciprocating the second indication hand at a predetermined period, and the first drive controller moving the first indication hand at a time interval equal to or less than a half of the predetermined period.

2. The time measurement device according to claim 1, wherein the first drive controller moves the first indication hand at a time interval equal to the half of the predetermined period.

3. The time measurement device according to claim 1, wherein the second drive controller reverses a movement direction of the second indication hand every 0.5 seconds or every one second.

4. The time measurement device according to claim 1, wherein the first indication hand is a second hand.

5. The time measurement device according to claim 1, further comprising:

a digital display unit that is configured to display a numeral image to indicate a higher digit of the measured time than the first indication hand.

* * * * *